US005137328A

United States Patent [19]

Smith et al.

[11] Patent Number: 5,137,328

[45] Date of Patent: Aug. 11, 1992

[54] PUSH-BUTTON CONTROLLED LATCHING DEVICE FOR RECLINING CHAIRS

[75] Inventors: Michael R. Smith; Gregory M. Lawson, both of Tupelo, Miss.

[73] Assignee: Super Sagless Corporation, Tupelo, Miss.

[21] Appl. No.: 638,442

[22] Filed: Jan. 4, 1991

[51] Int. Cl.[5] ..... A47C 1/02

[52] U.S. Cl. ..... 297/85; 297/68

[58] Field of Search ..... 297/68, 85, 75, 83, 297/84, 86, 434

[56] References Cited

U.S. PATENT DOCUMENTS

| | | | |
|---|---|---|---|
| 3,679,260 | 7/1972 | Morse-Brown | 297/68 X |
| 4,185,870 | 1/1980 | Johnson | 297/68 X |
| 4,249,772 | 2/1981 | Rogers, Jr. | 297/68 X |

FOREIGN PATENT DOCUMENTS

| | | | |
|---|---|---|---|
| 235889 | 10/1961 | Australia | 297/68 |
| 1529513 | 12/1969 | Fed. Rep. of Germany | 297/85 |
| 847946 | 9/1960 | United Kingdom | 297/85 |
| 8802610 | 4/1988 | World Int. Prop. O. | 297/68 |

*Primary Examiner*—Laurie K. Cranmer

*Attorney, Agent, or Firm*—Wolf, Greenfield, & Sacks

[57] ABSTRACT

A push button actuated latch used in reclining chairs wherein one part of the latch is mounted on the ottoman linkage and the complimentary part of the latch is mounted beneath the seat. When the ottoman is retracted beneath the seat as the chair moves to the upright position, the parts of the latch engage one another to retain the ottoman in the retracted position. When the push button is depressed, a cable attached between it and the latch releases the latch and allows the ottoman to extend and the chair to move to the reclined position.

12 Claims, 11 Drawing Sheets

PUSH-BUTTON CONTROLLED LATCHING DEVICE FOR RECLINING CHAIRS

INTRODUCTION

This invention relates to reclining chairs and more particularly to reclining chairs that are normally spring or gravity actuated to move from the upright to a reclining position. In spring actuated chairs the reclining mechanism is preloaded so as to cause the mechanism to open when the mechanism is released. In gravity actuated chairs, the weight of the chair occupant acting on the chair linkage mechanism causes the chair to recline. These linkage mechanisms have some form of latching device to prevent the chairs from moving from the upright to the reclining position, and various types of controls are provided for the latching device. Perhaps the most common type of control used in such chairs is a handle that is pivotally mounted on the outside of the chair arm. When the handle is actuated it releases the latching device, and the chair, acting under the influence of a spring or the weight of the occupant, moves to the reclining position.

In recent years a number of different types of latching mechanisms with a variety of controls have been developed. Examples of these are shown in U.S. Pat. Nos. 4,494,793, 4,506,926 and 4,668,009.

One important object of the present invention is to provide an improved push button controlled latch device for reclining chairs.

Another important object of the present invention is to provide a relatively inexpensive control for gravity operated chairs that can be applied to a wide variety of two way and three way reclining chair mechanisms and can be used in both recliners and incliners. (Incliners are reclining chairs that have a movable seat and back which are mounted within a fixed frame. They are sometimes call frame within-a frame recliners.)

Another object of this invention is to provide a push button control for reclining chairs that can be mounted on any convenient location on the arm or frame of the chair to accommodate the chair styling.

Another important object of this invention is to provide a control for recliners and incliners wherein the location of the latch that retains the chair in an upright position does not dictate the location of the control for releasing the latch.

To accomplish these and other objects the control for recliner and incliner chairs constructed in accordance with the present invention is composed of two major parts, namely, a latching device which is mounted either under the middle of the seat between the linkages disposed on each side of the seat or on one of the linkages at the side. The latching device is positioned to engage the ottoman linkage when the ottoman is retracted as the chair is brought to the upright position and prevents the ottoman linkage from extending the ottoman and the chair from moving to a reclining mode unless the latching mechanism is actuated so as to release the ottoman linkage. The control for the latching device is a push button assembly connected to the latching device by a cable. The push button assembly may be mounted on the inside, outside, top or front of the arm or on any other part of the chair frame which is conveniently accessible to the occupant of the chair. When the push button assembly is actuated, the cable causes the latching device to release the ottoman mechanism, and gravity will cause the chair to move to reclining position.

These and other objects and features of the present will be better understood and appreciated from the following detailed description of several embodiments thereof, selected for purposes of illustration and shown in the accompanying drawings.

BRIEF FIGURE DESCRIPTION

DETAILED DESCRIPTION

Figure 1:
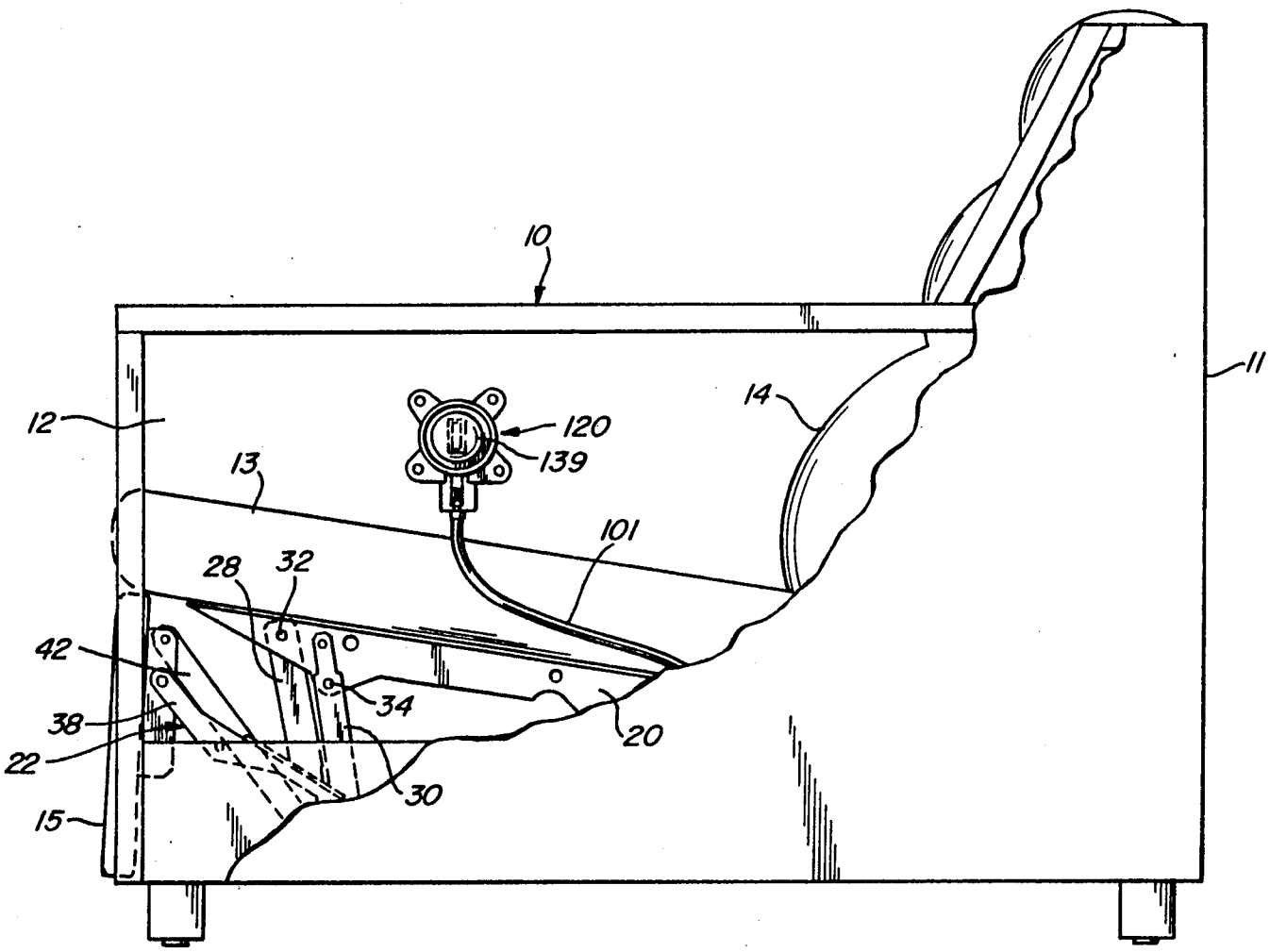
FIG. 1 is a side view of an incliner embodying the present invention and with part of the upholstery removed.

In FIG. 1 an incliner chair is shown having a fixed frame 10 with a fixed back 11 and arms 12 along with a movable seat 13 and backrest 14. In two way incliners the seat 13 and backrest 14 are rigidly connected together and move as a unit within the fixed frame 10 as the chair moves between its upright position and one or more inclining positions. The chair includes an ottoman 15 that is supported by an ottoman linkage 22 that enables the ottoman to move from the retracted position of FIGS. 1 and 2 to an extended position when the chair is reclined. A portion of the linkage mechanism is shown in detail in FIG. 2.

Figure 2:
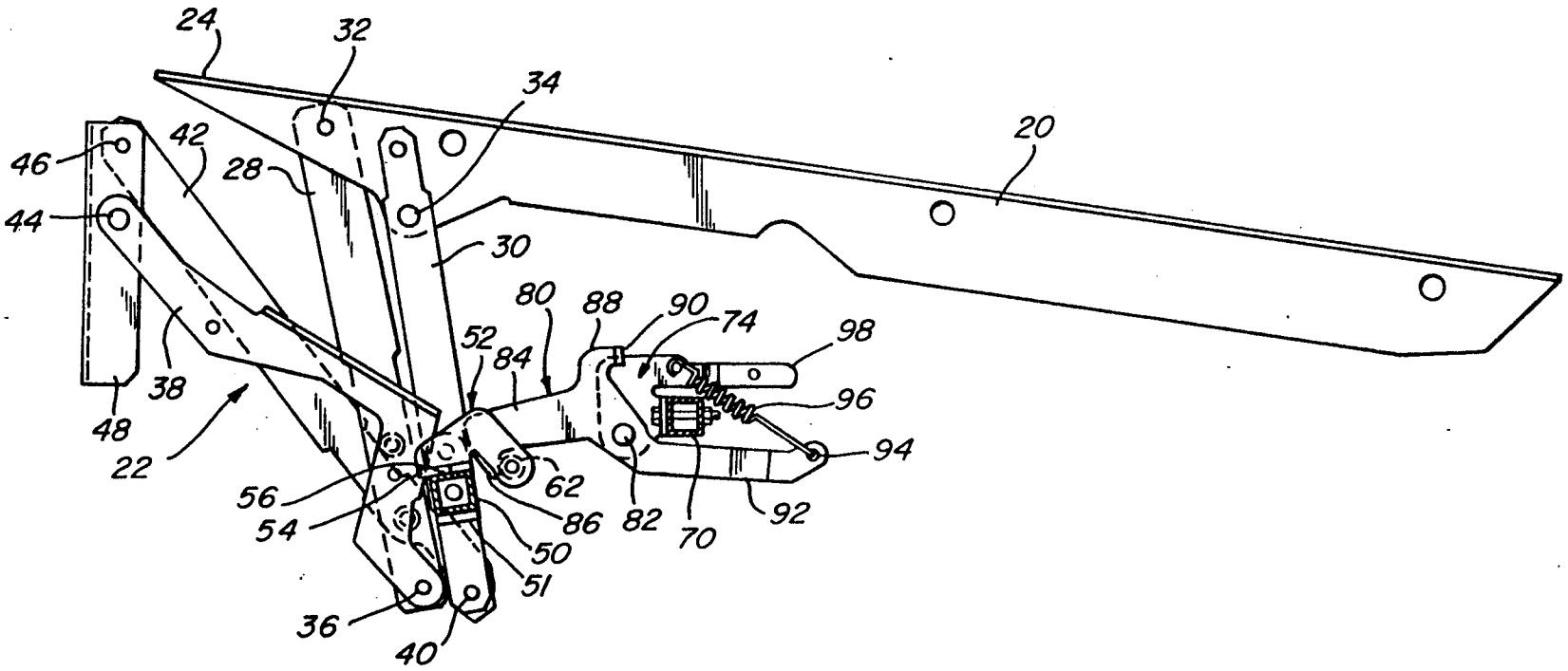
FIG. 2 is view of part of the reclining mechanism employed in the chair of FIG. 1 and showing the ottoman linkage in the retracted position and the latching device retaining the ottoman in the retracted position.
Figure 2A:
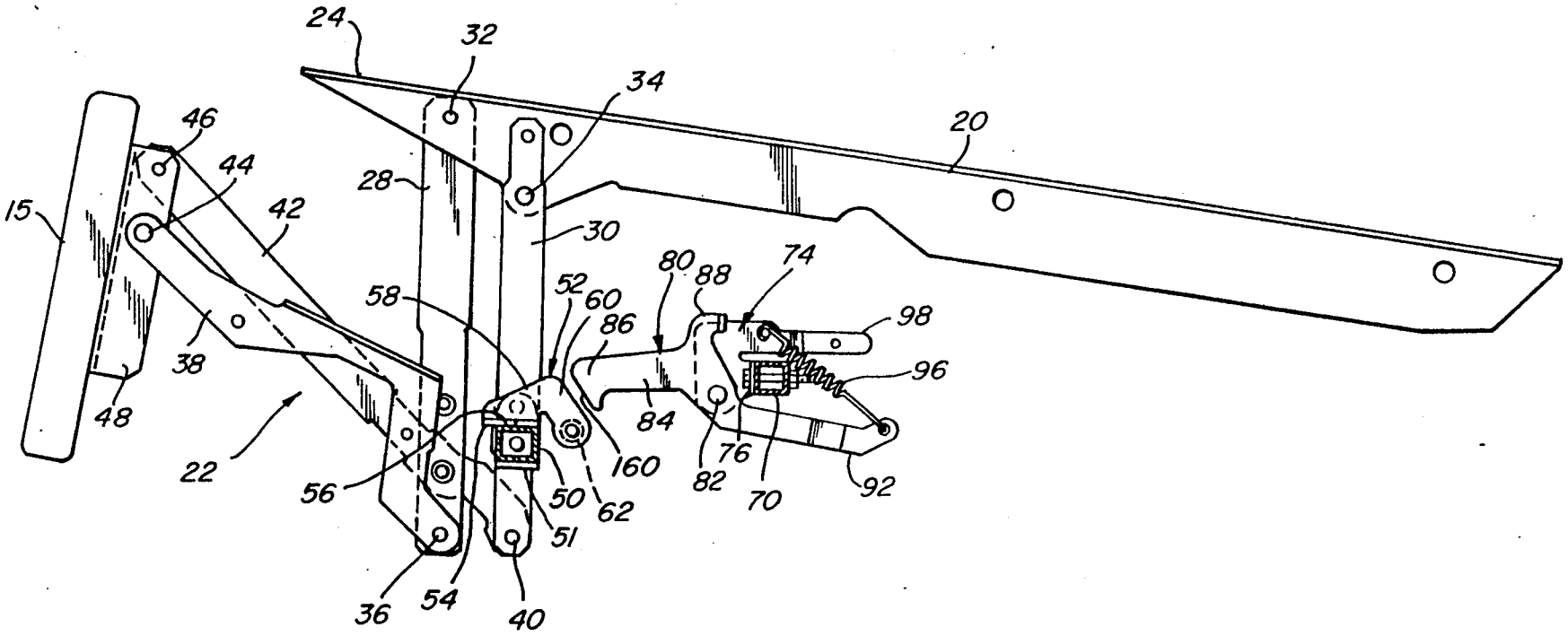
FIG. 2A is a fragmentary view of the mechanism of FIG. 2 with the ottoman linkage released and partially extended.
Figure 3:
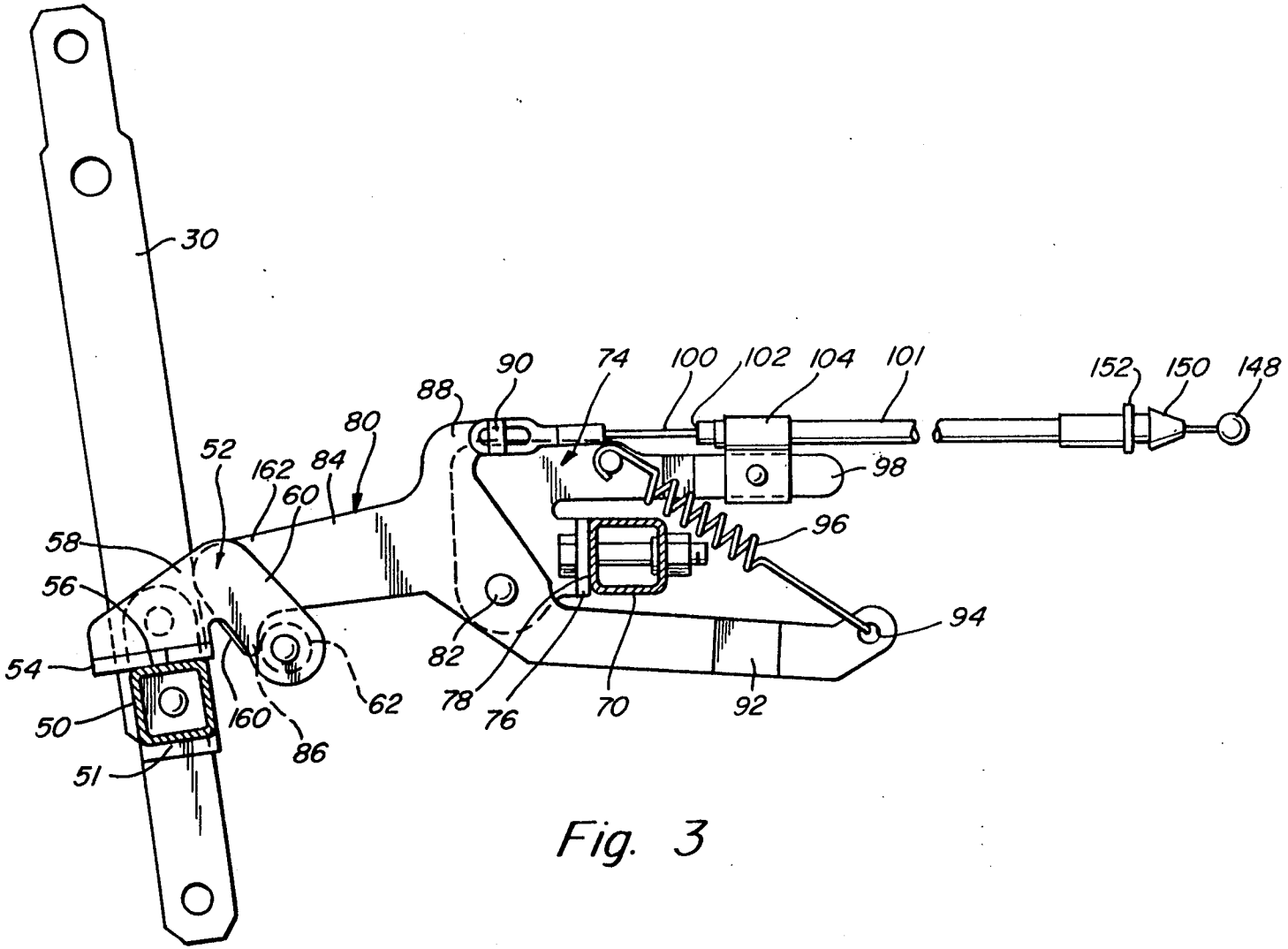
FIG. 3 is an enlarged detailed view of the latching device shown in FIG. 2.

In FIGS. 2, 2A and 3, a portion of a reclining chair mechanism is shown including the seat mounting link 20 that is attached directly to the frame of the seat of the chair. The ottoman linkage 22 is mounted on the front end 24 of the seat mounting link 20 and may be of generally conventional design for carrying the ottoman 15. The linkage 22 is of the lazy tong type and includes first and second links 28 and 30 pivotally mounted at their upper ends on the seat mounting link 20 by pivots 32 and 34, respectively. The lower end of the first ottoman link 28 is connected by pivot 36 to the third ottoman link 38 while the lower end of the second ottoman link 30 is pivotally connected by pivot 40 to the fourth ottoman link 42. The free ends of the third and fourth ottoman links are connected by pivots 44 and 46 to the ottoman bracket 48 which carries ottoman 15.

The mechanism described above is duplicated on each side of the chair, and the ottoman linkages 22 on each side are connected to one another by a cross tube 50 mounted at opposite ends by means of the brackets 51 to the second ottoman links 30 of each ottoman linkage. Obviously only one ottoman linkage is shown although two are present, one on each side of the chair. At its approximate center, cross tube 50 carries a bracket 52. Bracket 52 has a flange 54 which is riveted, welded, or otherwise secured to the upper surface 56 of the cross tube. The bracket 52 is shaped as an inverted V with the flange 54 formed at the lower end of the front arm 58, while the lower end of the rear arm 60 carries a pin 62 that forms part of the push button controlled latch.

A second cross tube 70 is shown in FIGS. 2, 2A and 3. The second tube is connected to the mounting links (not shown) which in turn are attached to the wood frame 10 of the chair. Obviously, the tube 70 extends across the chair to the second linkage on the other side. The mounting links (not shown) support the linkage mechanisms along with the seat 13, backrest 14 and ottoman linkage 22 and ottoman 15 on the fixed frame 10 of the chair as is shown, for example in U.S. Pat. No. 4,805,960 assigned to the assignee of the present invention. The disclosure of that patent is incorporated by reference herein. The cross tube 70 remains stationary, and the ottoman linkage 22, seat link 20 and the rest of the mechanism move with respect to the cross tube and mounting link. A bracket 74 having a flange 76 is mounted on the side 78 of the cross tube 70 and in turn pivotally supports a latch 80 by means of pivot 82. The latch 80 has a forwardly extending finger 84 which in turn has a hook 86 at its forward end which is adapted to engage the pin 62 carried by bracket 52 when the ottoman linkage 22 is retracted as shown in FIG. 2. The latch 80 also has a second finger 88 extends upwardly from the pivot 82, and the free end of that finger has a flange 90 that is adapted to be connected to the cable 100 of the push button control as is more fully described below.

Latch 80 has a third rearwardly extending finger 92, having a hole 94 at its rearmost end for aging one end of a coil spring 96 that extends between the finger 92 and the rearwardly extending arm 98 of the mounting bracket 74. Spring 96 urges the latch to turn counterclockwise as viewed in FIG. 3.

The latch 80 is caused to pivot clockwise as viewed in FIGS. 2 and 3 s a release the pin 62 and enable the ottoman linkage 22 to extend the ottoman 15 to and beyond the position of FIG. 2A by cable 100 which is secured to the flange 90 carried on the finger 88 of the latch. The jacket 101 that encloses the cable 100 extends from the flange 90 rearwardly through an opening 102 in a clamp 104 mounted on the rearwardly extending arm 98 of the mounting bracket 74. When the cable is pulled to the right as viewed in FIGS. 2 and 3, the latch 80 rotates clockwise to the position of FIG. 2A, causing the hook 86 to elevate and release the pin 62. That action overcomes the bias of coil spring 96 which urges the latch to turn counterclockwise on pivot 82. When the cable tension is released, the latch 80 will return to the influence of coil spring 96 and turn to the position shown in FIGS. 2 and 3.

Figure 4:
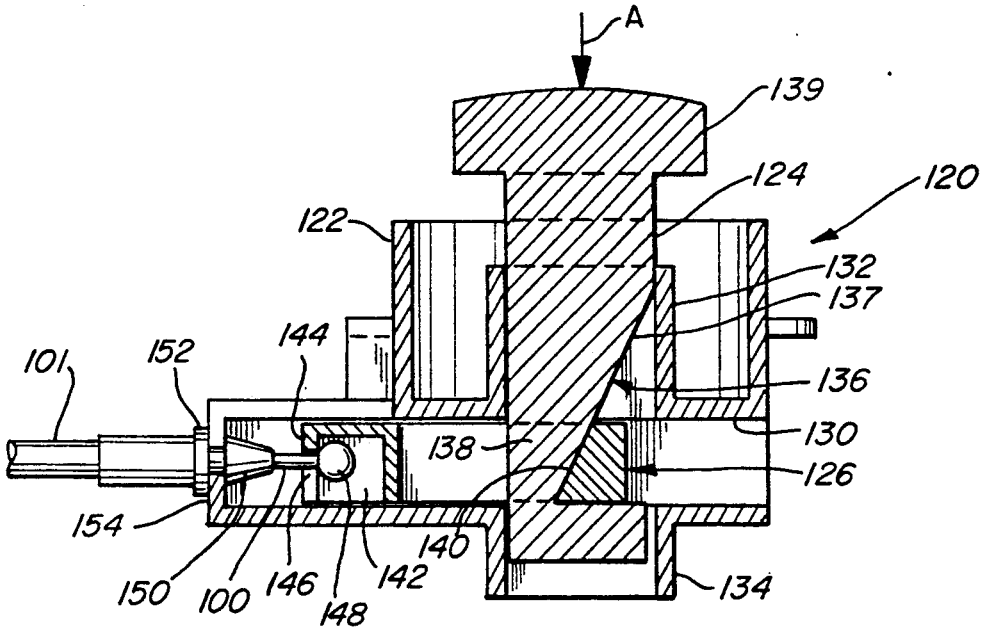
FIG. 4 is cross-sectional view of the push button control used in the chair of FIG. 1 and in combination with the latching device of FIGS. 2 and 3 to control its operation.
Figure 5:
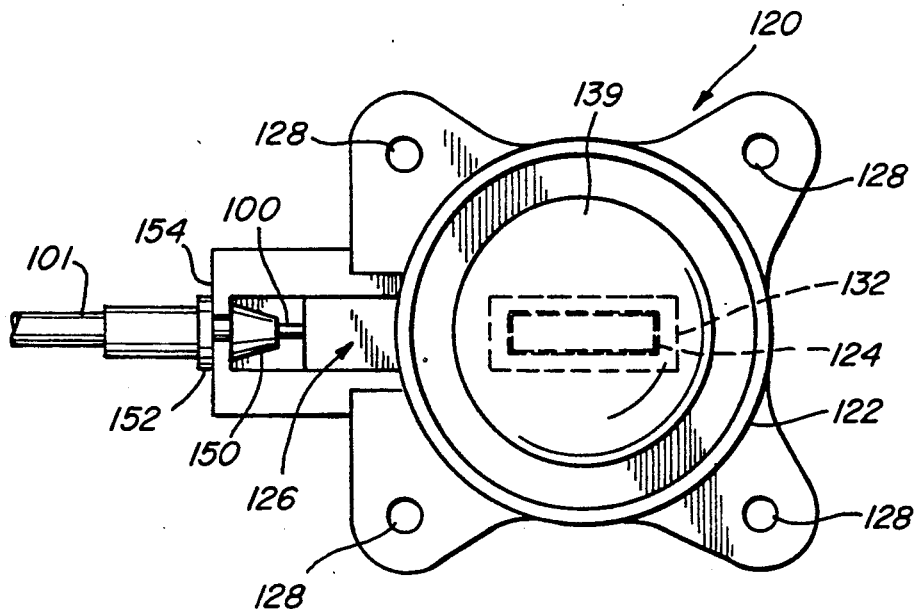
FIG. 5 is a plan view of the push button assembly shown in FIG. 4.

The other end of the cable 100 is secured to the push button assembly 120 shown in FIGS. 4 and 5 which operates the latch. It is to be understood that at the details of the push button assembly do not form part of the present invention, and other types of push button activators may be used. The assembly shown is a convenient device for actuating the cable for controlling the latch.

The push button assembly includes a housing 122, a push button actuator 124, and a slide 126. The slide is connected to the cable 100 and when the push button is depressed, it draws the cable 100 to the right as viewed in FIG. 4 so as to pivot the latch 80 about the pivot mounting 82. The housing 122 has a number of ears 128 that facilitate attachment of the push button assembly 120 to the chair. The assembly may be attached to the top, front, inside or outside of the arm 12 or may be connected at any other convenient location on the chair frame 10.

The slide frame 126 moves within a channel 130 in the housing, and it is controlled by the push button 124 mounted in the housing and limited to axial motion by the two collars 132 and 134 formed as an integral part of housing 122. A cam surface 136 in the form of a ramp 137 is provided on the stem portion 138 of the push button actuator 124, and that ramp engages a complimentary ramp 140 formed on slide 126. As is evident in FIG. 4, when the push button 124 is depressed in the direction of arrow A, by means of its knob 139, slide 126 will move to the right and draw the cable 100 to the right with it.

The slide 126 has a small chamber 142 formed at is left end, which is open at its bottom and is partially closed at its left end by wall 144. A slot 146 is provided in the wall 144 so that the enlarged end 148 of the cable may be slipped into the chamber 142. A plug 150 carried by the cable jacket 101 bears against the inside surface of the end wall 154, and a block 152 also carried by the cable jacket 110 engages the outside surface of the end wall 154 to retain the cable jacket in position.

The coil spring 96 which urges the latch 80 to rotate in a counterclockwise direction about the pivot 82 serves to bias the cable 100 to the left as viewed in FIGS. 3 and 4, which in turn draws the slide 126 to the position shown in FIG. 4, which in turn elevates or extends the push button 124 in a direction opposite that of arrow A. When the push button 124 is released, it therefore returns to the elevated position, and the latch 80 turns counterclockwise so as to assume the position of FIGS. 2 and 3.

It will be noted in FIGS. 2 and 3 that a ramp 160 is provided on the end 162 of finger 84 of latch 80 beyond the hook 86. As the ottoman 15 and the ottoman linkage 22 return to the retracted position, the latching pin 62 will engage the ramp 160 and force the latch 80 to pivot upwardly on its pivots so that the pin 62 will pass under and behind the hook 86 and be engaged by it. When the hook engages the pin, the ottoman 15 and its linkage 22 will be retained in the retracted position until the pin is released by the latch 80 in response to the actuation of the push button.

Figure 6:
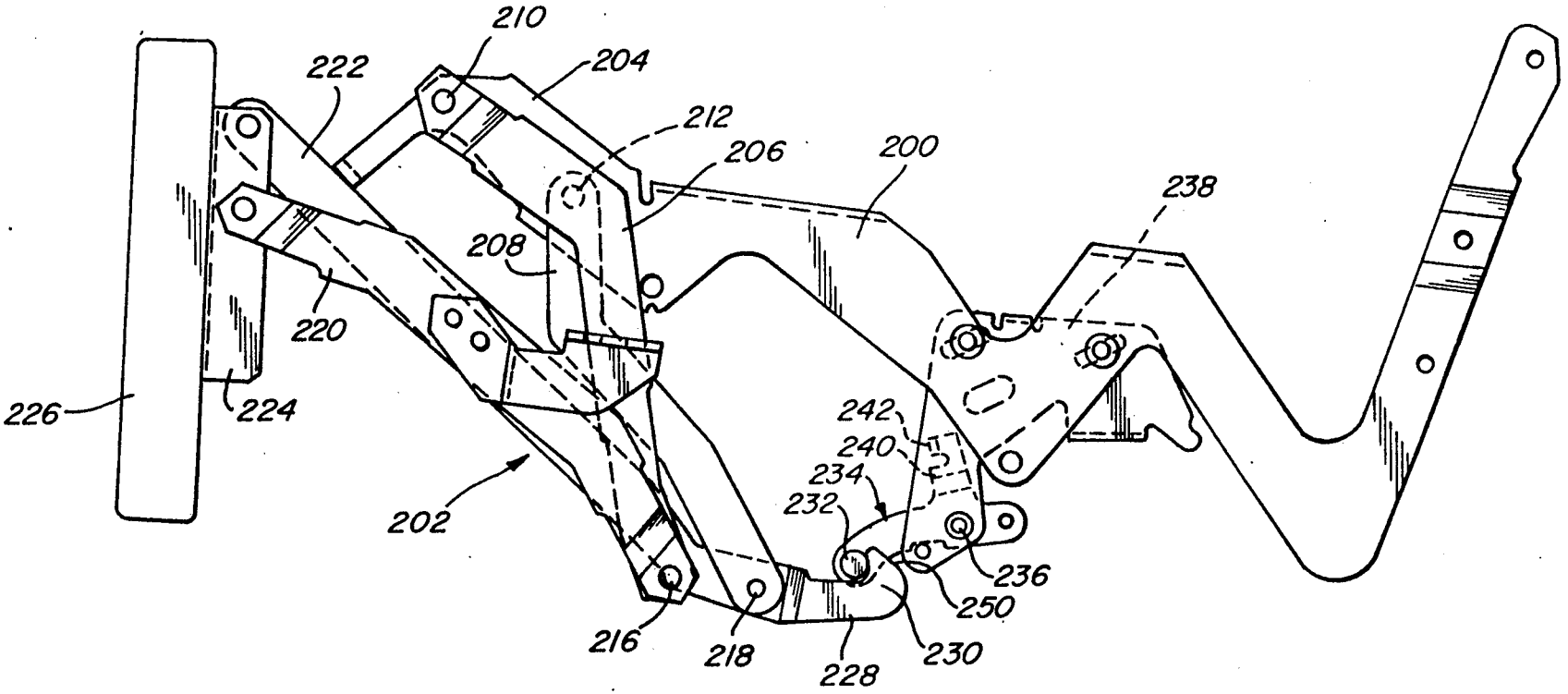
FIG. 6 is a side view of a recliner mechanism embodying another latching device constructed in accordance with this invention, with the ottoman linkage retracted.
Figure 6A:
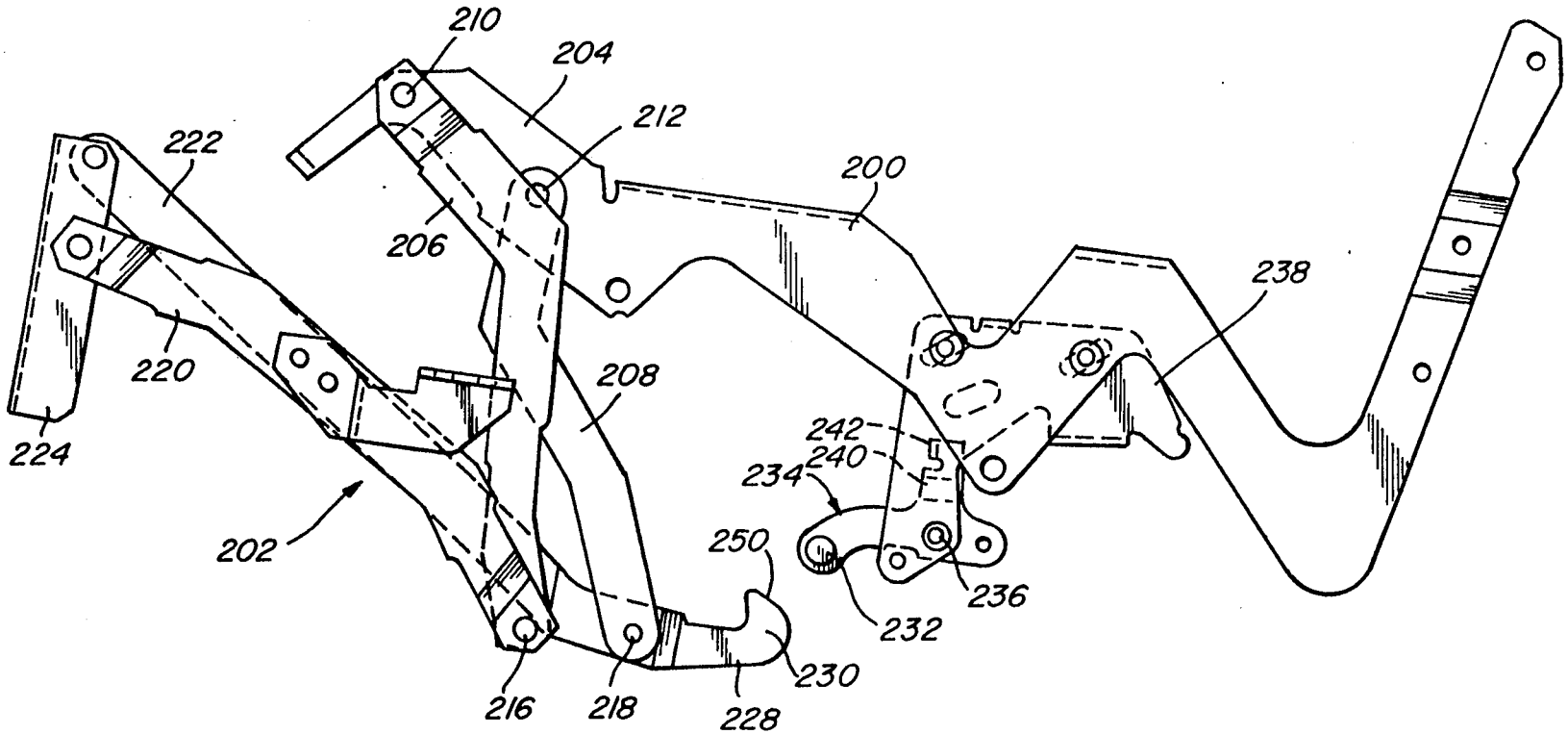
FIG. 6A is a fragmentary view of the mechanism of FIG. 6 but with the ottoman linkage released and partially extended.
Figure 6B:
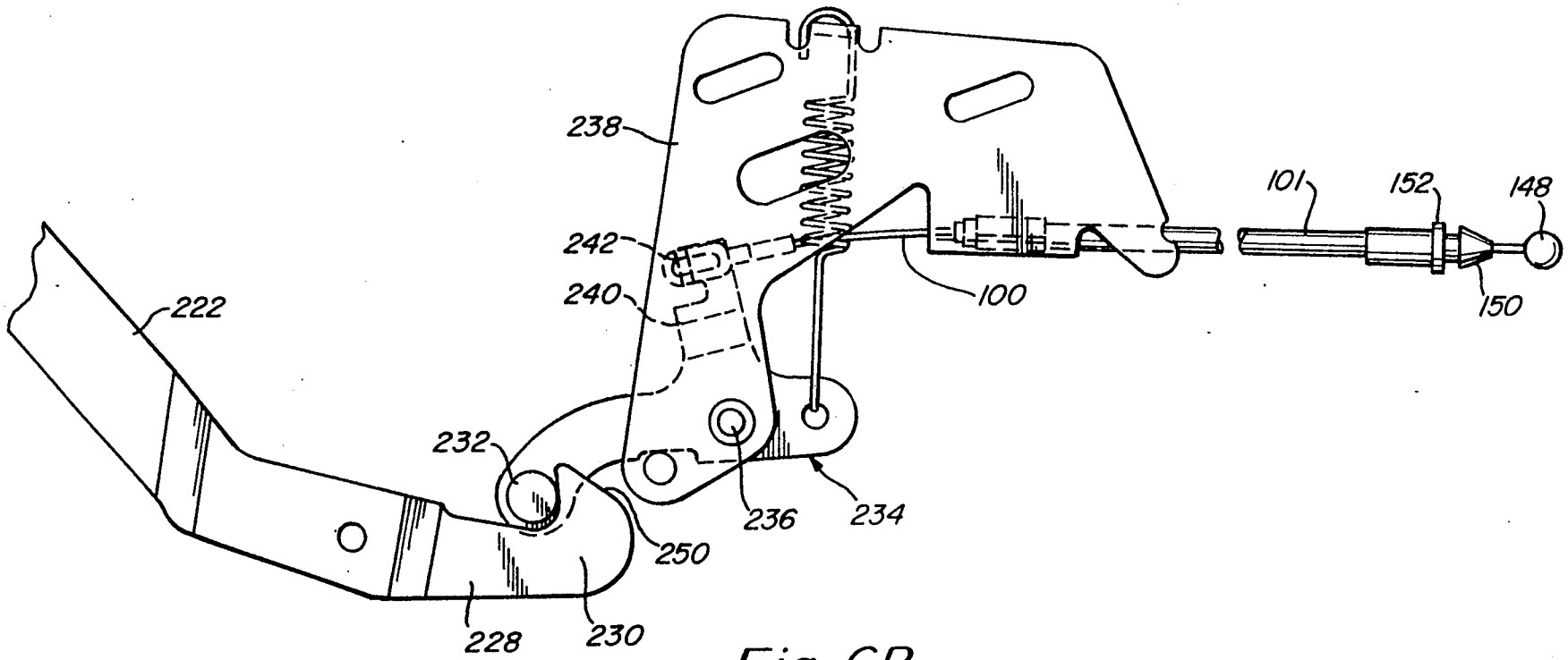
FIG. 6B is an inlayed detailed view of the latching device shown in FIGS. 6 and 6A.

In FIGS. 6, 6A and 6B another embodiment of the present invention is shown, In this embodiment, the position of the hook and pin are reversed and the two are mounted directly on one of the recliner mechanisms at one side of the chair as opposed to the cross tubes at the center of the seat as in the incliner embodiment of FIGS. 2 and 2A. The push button assembly of this embodiment may be the same as that shown in FIGS. 4 and 5, and therefore its description will not be repeated.

In FIGS. 6 and 6A, a seat mounting link 200 is shown, and an ottoman linkage 202 is pivotally supported on its front end 204. The ottoman linkage includes first and second ottoman links 206 and 208 pivotally connected at their upper ends by means of rivets 210 and 212, respectively, to the seat mounting link 200. The other ends of the links 206 and 208 are connected by means of rivets 216 and 218 to the lower ends of third and fourth ottoman links 220 and 222. The free ends of the links 220 and 222 in turn pivotally support the ottoman bracket 224 which carries the ottoman 226.

The fourth ottoman link 222 carries an extension 228 which has a hook 230 at its free end. The hook 230 is designed to engage pin 232 carried by the pivotally mounted bracket 234 supported by pivot rivet 236 on plate 238 that is secured to the seat mounting link 200. The bracket 234 has a finger 240 on its upper side which in turn carries a flange 242 adapted to be secured to the cable 100 that actuates it.

In FIG. 6, the ottoman linkage 202 is shown in its retracted position wherein the ottoman is disposed under the seat as in FIG. 1 and it is retained in that position by engagement of the hook 230 of extension 228 with the pin 232 carried on the bracket 234. To release the ottoman linkage so that it may move to and beyond the extended position of FIG. 6A, the bracket 234 carrying pin 232 is rotated in a clockwise direction by the pull exerted on it by the cable 100 secured to the flange 242 on the bracket finger 240. This action lifts the pin 232 out of engagement with the hook 230 so that the ottoman linkage 202 is free to move to and beyond the position of FIG. 6A and extend the ottoman 226.

As in the embodiment of FIGS. 2-3 the rear bracket 234 to pivot upwardly as the ottoman linkage retracts and the hook engages the pin 232. In this fashion the hook 230 engages the pin and serves to retain the ottoman in the retracted position. The ottoman and its linkage 202 will remain in that position until the push button is depressed so as to elevate the pin 232 as in FIG. 6A and release the hook 230.

Figure 7:
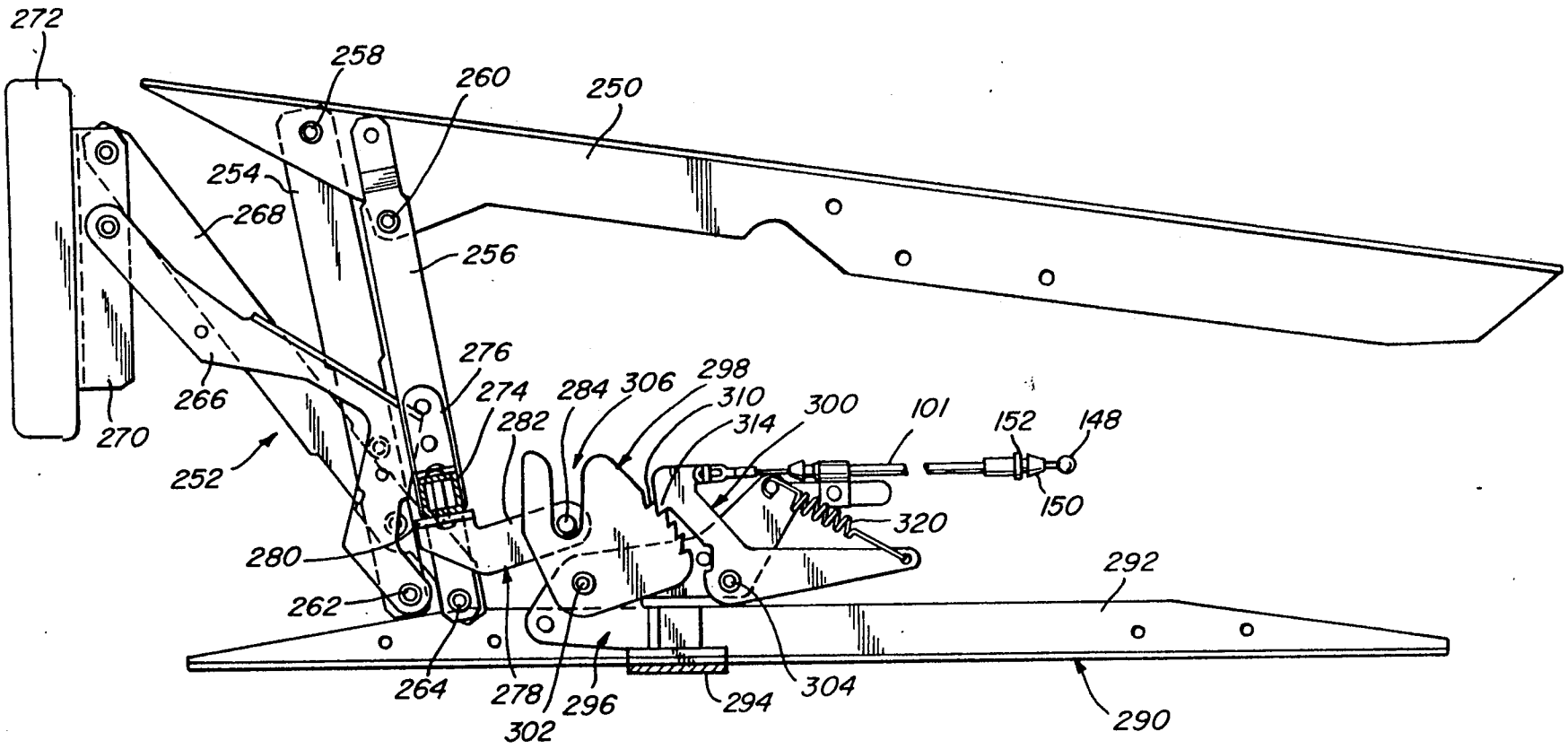
FIG. 7 is a side view of another incliner mechanism embodying a latching device constructed in accordance with this invention and showing the ottoman linkage in the retracted position.
Figure 8:
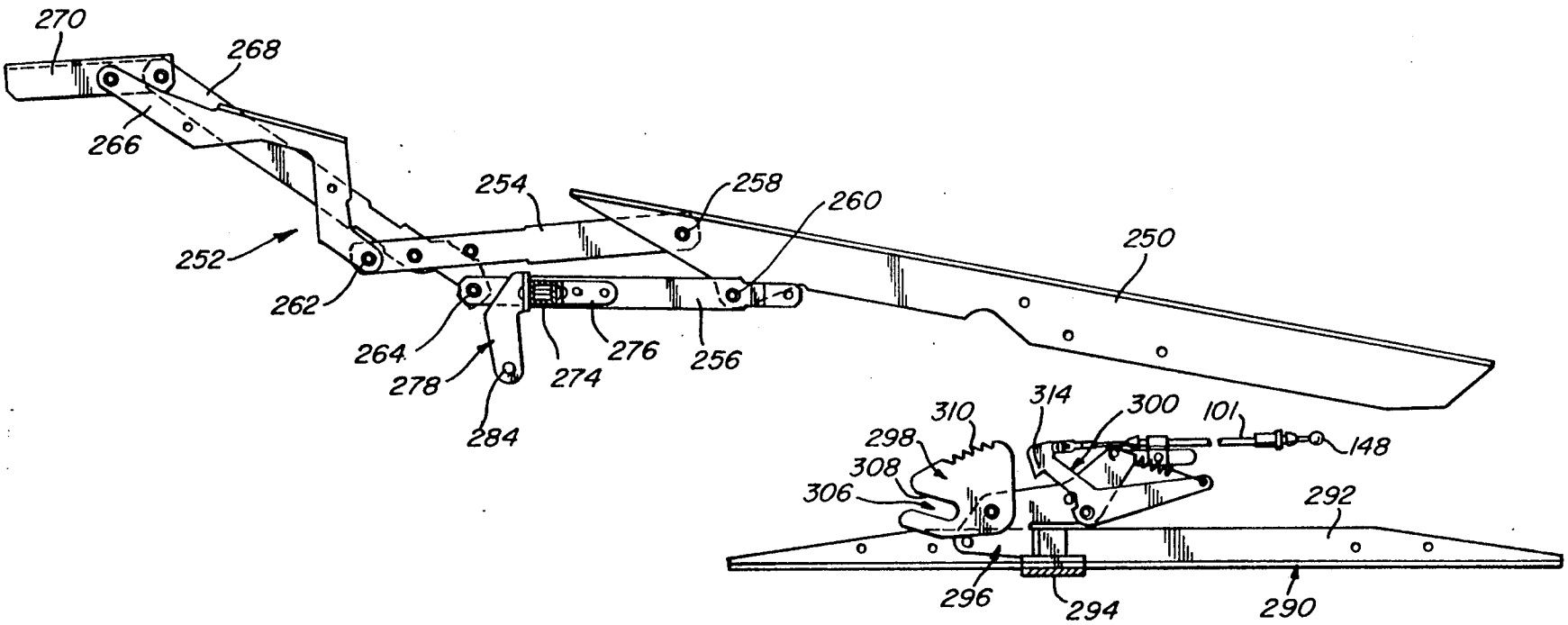
FIG. 8 is a view of the mechanism of FIG. 7 but with the ottoman in the extended position.
Figure 9:
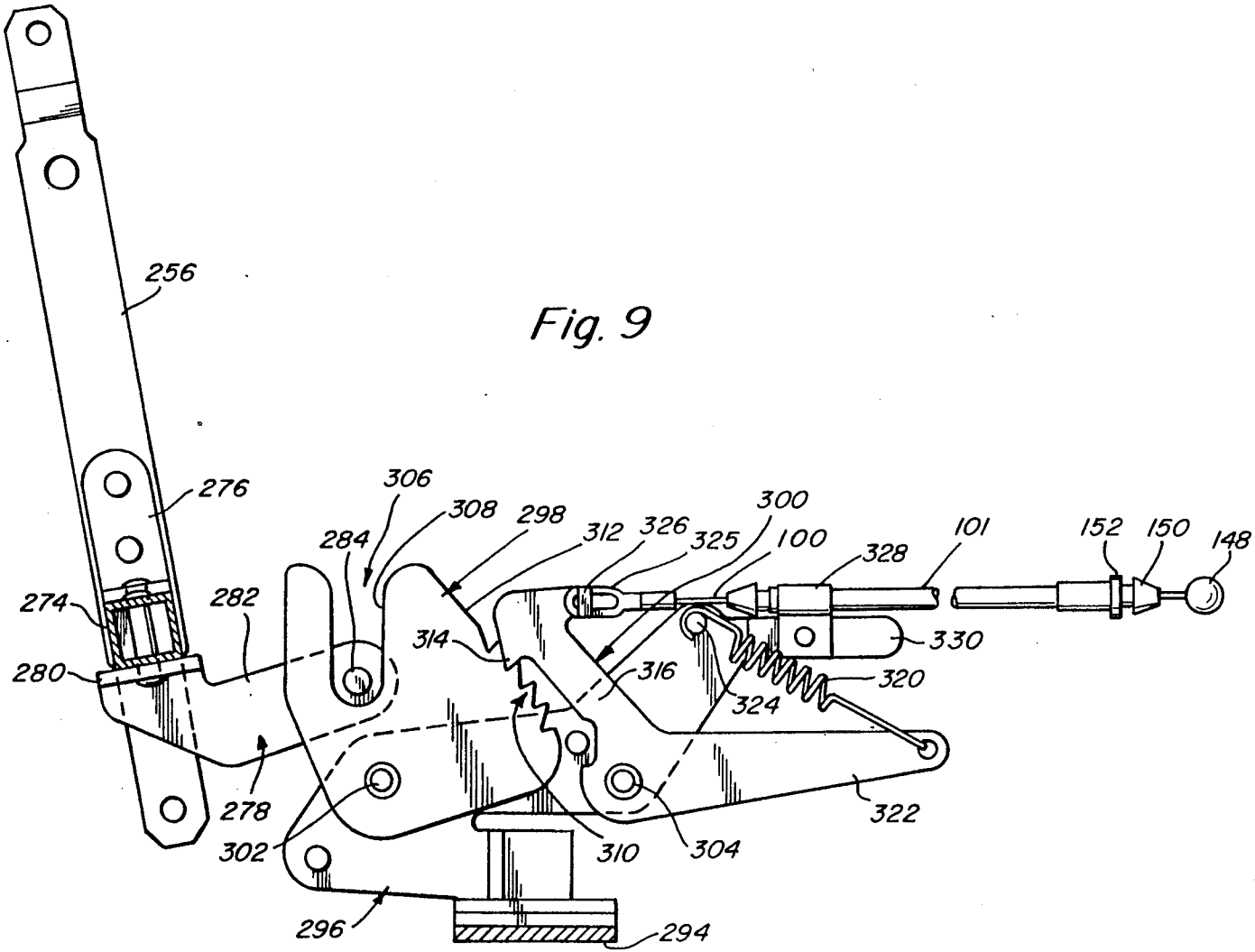
FIG. 9 is a enlarged detailed view of the latching mechanism and a portion of the ottoman linkage shown in FIGS. 7 and 8.

In FIGS. 7-9, yet another embodiment of the invention is shown. In this embodiment like the embodiment of FIG. 2, the latching arrangement to retain the ottoman in the retracted position is located under the center of the seat as opposed to the side of the seat directly on one of the linkage mechanisms. In this embodiment, seat link 250 which supports the chair seat (not shown) carries ottoman linkage 252 at its front end. The ottoman linkage includes first and second ottoman links 254 and 256 pivoted to the front of seat link 250 by rivets 258 and 260, respectively, and the first and second links in turn are connected at their other ends by pivots 262 and 264 to third and fourth ottoman links 266 and 268, respectively. The ottoman links 266 and 268 are pivotally connected to the ottoman bracket 270 that carries the ottoman 272.

As in conventional in reclining chairs, the linkage system just described is duplicated on both sides of the chair, an in this embodiment, a cross tube 274 is connected to the second ottoman links 256 on each side by the angles 276. At the center of the cross tube, a pin bracket 278 is secured to the tube by flange 280. The pin bracket has a rearwardly extending finger 282 that carries a pin 284 which is engaged by the latch when the ottoman linkage is retracted.

The reclining mechanism is shown in FIGS. 7 and 8 to include a base 290 having base links 292 that are joined together by cross bar 294. The cross bar 294 at its center supports a fixed bracket 296 aligned fore and aft with the pin 284 carried by bracket 278 on the ottoman linkage. The bracket 296 pivotally carries both a latch 298 and a latch retainer 300 mounted for pivotal motion on the bracket 296 by the pivots 302 and 304, respectively.

The latch 298 has a slot 306 open at the top when positioned as shown in FIGS. 7 and 9 and disposed so as to be open in a forward direction (see FIG. 8) when the latch is released by the retainer 300. Therefore, as the ottoman linkage 252 closes (moves from the extended position of FIG. 8 to the retracted position of FIG. 7) and the second link 256 moves to the right as shown in FIG. 8 (pivoting counterclockwise about the pivot point 260), the pin 284 carried by bracket 278 will enter the slot 306 and engage the side edge 308 thereof so as to pivot the latch 298 clockwise on its pivot 302. This motion will continue until the ottoman 272 is in the fully retracted position of FIG. 7. As this occurs the ratchet 310 formed along the edge 312 of the latch will engage the tooth 314 in the arm 316 of the retainer 300. The tooth 314 of the retainer will ride up successively on the teeth of the ratchet 310 starting at the bottom, and the tooth 314 will prevent the latch 298 from turning counterclockwise. Thus, slot 306 will hold the pin 284 and prevent the ottoman linkage from opening or extending so as to elevate the ottoman to the position of FIG. 8. The plurality of teeth provided in the ratchet provides flexibility in the chair design by enabling the latch 298 to hold the ottoman linkage in the retracted position while compensating for different upholstery thicknesses and chair styles.

The retainer 300 which controls latch 298 is in turn controlled by a coil spring 320 hooked to the rear end of arm 322 of the retainer and the pin 324 at the upper end of the bracket 296. The spring 320 urges the retainer 300 to turn counterclockwise on pivot 304 so that its tooth 314 engages the ratchet 310. However, the retainer 300 is moved clockwise about its pivot 304 so as to release the plate 298 by the actuation of the push button which may be identical to the push button assembly shown in FIGS. 4 and 5. For that purpose, the cable 100 carries a loop 325 secured to the post 326 at the upper end of arm 316 of retainer 300, and the cable jacket 101 is secured in place by the clamp 328 mounted on finger 330 of the bracket 296. The clamp 328 engages the cable jacket while permitting the cable free motion as controlled by the push button assembly.

In the foregoing description, three different control mechanisms for use in reclining chairs are described. These mechanisms have application both in recliners and incliners and in both two-way and three-way reclining mechanisms. Typically, in recliners, one part (either the pin or latch) of the latching device may be mounted on the seat link and move with it while the other part is mounted on one of the ottoman links. In incliners, the latching devices are advantageously mounted at or near the center of the chair midway between the side linkages, and one part may be attached to a tube that extends between the reclining mechanisms such as the mounting links which are normally fixed to the sides of the stationary wood frame. The companion part of the latching mechanism, typically movable with the ottoman linkage, is disposed on a tube that extends between the two ottoman linkages on the sides of the ottoman.

Having described the invention in detail those skilled in the art will appreciate that numerous modifications may be made thereof without departing from the spirit of the invention. Therefore, it is not intended that the scope of this invention be limited to the specific embodiments illustrated and described. Rather, its scope is to be determined by the appended claims and their equivalents.

We claim:

1. A reclining chair comprising a seat, backrest and ottoman movable between upright and reclined positions, an ottoman linkage carrying the ottoman for movement between a retracted position when the chair is upright and an extended position when the chair is reclined, a pin connected to and movable with the ottoman linkage, a latch mounted on the chair releasable engaging the pin for retaining the ottoman linkage in the retracted position when the pin is engaged and enabling the ottoman to extend when the pin is disengaged, and a control mounted on the chair and including a cable connected to the latch, actuation of the control causing the latch to release the pin, wherein the latch is a pivotally mounted plate, wherein the plate has a slot into which the pin extends to retain the linkage in the retracted position, and wherein a retainer link is pivotally mounted adjacent said plate, a rack is formed on the plate and a tooth is formed on the retainer link and positioned to engage the rack for holding the plate in a position causing the slot to retain the pin, and said cable is connected to the retainer link whereby actuation of the control releases the retainer which in turn allows the plate to pivot so that the slot disengages the pin.

2. A reclining chair as defined in claim 1 wherein the latch is a hook-shaped member pivotally mounted under the seat.

3. A reclining chair as defined in claim 1 wherein a seat mounting link carries the seat and said latch is mounted on the seat mounting link.

4. A reclining chair as defined in claim 1 wherein a cross member is disposed beneath the seat and said latch is mounted on the cross member.

5. A reclining chair as defined in claim 3 wherein the latch is a pivotally mounted hook-shaped member.

6. A reclining chair as defined in claim 4 wherein the latch is a pivotally mounted hook-shaped member.

7. A reclining chair having a seat and backrest and an ottoman movable between retracted and extended positions, a mechanism for moving the ottoman between the extended and retracted positions, a first latch means connected to the mechanism and movable with the mechanism as the ottoman moves from one to the other of the positions, a second latch means complimentary to the first latch means and mounted on the chair for releasably retaining the first latch means when the ottoman is retracted, a cable connected to the second latch means, and a push button assembly mounted on the chair and accessible to an occupant of the chair for moving the cable to cause the second latch means to release the first latch means so that the mechanism may extend the ottoman, wherein the second latch means is biased to a position to engage the first latch means when the ottoman is retracted, wherein said second latch means includes a plate having a slot and movable between first and second positions, said slot engaging the first latch means for holding the ottoman in the retracted position when the plate is in a first position and releasing the first latch means when the plate is in a second position, and a retainer mounted adjacent the plate to releasably hold it in the first position, and wherein a tooth and ratchet are provided on the plate and a retainer enabling the retainer to engage the plates, and said cable is attached to the retainer for causing the retainer to move and disengage the plate.

8. A reclining chair as defined in claim 7 wherein;

the second latch means is pivotally mounted beneath the seat.

9. A reclining chair as defined in claim 7 wherein the second latch means is pivotally mounted beneath the center of the seat.

10. A reclining chair as defined in claim 7 wherein said second latch means includes a hook for engaging the first latch means.

11. A reclining chair as defined in claim 7 wherein said first latch means includes a pin for engaging the second latch means.

12. A reclining chair as defined in claim 7 wherein the first latch means includes a hook.

* * * * *